US005415277A

United States Patent [19]

Berntsen

[11] Patent Number: 5,415,277

[45] Date of Patent: May 16, 1995

[54] MULTIPURPOSE STACKABLE CARRIER

[75] Inventor: William O. Berntsen, Wyckoff, N.J.

[73] Assignee: Barbara A. Bernsten, Sloatsburg, N.Y.

[21] Appl. No.: 128,350

[22] Filed: Sep. 28, 1993

[51] Int. Cl.[6] ..... B65D 75/00; B65D 21/00; B65D 85/62

[52] U.S. Cl. ..... 206/144; 206/162; 206/429; 206/510

[58] Field of Search ..... 206/139, 144, 162, 427, 206/429, 434, 503, 509, 510; 220/23.83

[56] References Cited

U.S. PATENT DOCUMENTS

| | | | |
|---|---|---|---|
| 491,865 | 2/1893 | Wynn | 206/503 X |
| 3,330,608 | 7/1967 | Druger, Jr. | 206/509 X |
| 3,811,559 | 5/1974 | Caster | 206/509 X |
| 4,078,701 | 3/1978 | Clubb | 206/509 X |
| 4,143,765 | 3/1979 | Moss, III | 206/445 |
| 4,342,388 | 8/1982 | Torokvei | 206/510 X |
| 4,579,489 | 4/1986 | Sarantitis | 206/509 X |

*Primary Examiner*—Jacob K. Ackun, Jr.
*Attorney, Agent, or Firm*—Mitchell A. Stein

[57] ABSTRACT

A system of stackable containers including a plurality of carriers, each container comprising means for linking a carrier with a next adjacent stacked carrier, a plurality of means for containing objects, a handle, adapted to suspend the carrier and containers and a plurality of inferiorly stacked carriers with containers, and a lower recess adapted to receive a handle from an inferior stacked carrier.

4 Claims, 10 Drawing Sheets

MULTIPURPOSE STACKABLE CARRIER

FIELD OF THE INVENTION

The present invention relates to the field of portable multirecepticle carriers for containers, and more particularly to the field of stackable carriers for organizing a plurality of containers.

BACKGROUND OF THE INVENTION

Many types of multirecepticle carriers containers are known in the art, including, e.g., "six-packs" of soda or beer cans, in which six aluminum or steel beverage cans are arranged in a two-by-three array with a planar-film plastic carrier. Further, the design of the cans is such that the bottom of one can interfits with the top of another, allowing them to be efficiently stacked.

Likewise, the art also recognizes that cans or containers may be placed in cardboard boxes for storage and transport.

The art also clearly appreciates the need for an ergonomic design for portable containers, and thus has configured many types of handles and closures adapted for use by people.

OBJECTS OF THE PRESENT INVENTION

It is therefore an object of the present invention to provide a stackable carrier for a plurality of containers, having an ergonomic suspension for transport, a plurality of means each adapted to accept a container, and means for linking the carrier to a superior or inferior adjacent carrier.

It is a further object of the present invention to provide a carrier for a plurality of containers, said carrier having a plurality of apertures adapted to hold a container in a planar array, a handle having an elongated grip portion having an axis, said axis being spaced above said planar array, a recess defined in a bottom portion of said carrier adapted to receive a corresponding handle from an inferiorly adjacent-like carrier, and an adaptor for interconnecting said carrier with a downwardly adjacent carrier.

It is a still further object of the present invention to provide a system of stackable containers comprising a plurality of carriers, each container comprising means for linking a carrier with a next-adjacent stacked carrier, a plurality of means for containing objects, a handle or adapted to suspend the carrier and a plurality of inferiorly stacked carriers, and a lower recess adapted to receive a handle from an inferiorly stacked carrier.

These and further objects will be apparent from a detailed description of the preferred embodiments.

SUMMARY OF THE INVENTION

The carrier of the present invention is uniquely configured as a portable organizer preferably made of heavy-duty plastic, and more preferable from a moldable thermoplastic. The carrier includes a tray, which is preferably designed to hold six containers in a planar two-by-three array. These containers can be used to hold and contain small parts, such as hardware, including nuts, bolts, screws, nails, washers, shims, weights, fittings, and the like. The six containers may each be, e.g., a standard 4 inch diameter, 5½" inch high can, such as is used to package coffee. Other size containers may also be used. Further, the containers need not necessarily be round, although round containers are preferred.

Because the individual containers may be standard sizes, the carrier may be used to package standard goods, with the reusable carrier provided as an incentive to the purchaser. After the goods in the container, which may be comestibles, are consumed, the metal can of the container may be reused for other goods in conjunction with the carrier. This therefore addresses and resolves a concern of many consumers that the packaging materials be environmentally suitable. Likewise, when sold with contents, the containers may contain labels that serve as continuing advertisements each time they are used. This is particularly advantageous for trademark based merchandising. Thus, the reusability and multipurpose nature of the containers and carrier are advantageous.

The carrier is preferably designed to allow the efficient packing density of the containers, so that, if the carrier is included with multipacks of product, then the shipping cost of the carrier may be minimized. Likewise, the carrier of the present invention may alleviate the need for other shipping apparatus.

The carrier of the present invention may comprise apertures which encircle the containers, or may partially encircle the container, with a portion of the container not encircled. Further, the attachment system may include a complementary-shaped receptacle for an interfitting, or force-locked or form-locked engagement, or of a different type of attachment. A force-locked engagement allows frictional forces to hold the container to the carrier. A form-locked engagement allows a mechanically interfitting interaction to retain the container in the carrier.

Other sorts or engagements are possible. For example, steel cans may be held in place through the use of magnets, though the capacity of the container and ease of disassembly may be compromised. Adhesive or thermal fusion techniques may also be used to connect the container to the carrier. Further, in one embodiment, the container may be formed integrally with the carrier.

The handle portion extends upward from the upper aspect of the container. This allows clearance from the top of the carrier/container structure to the hand of a person. The handle may be of any known type, and is preferably integrally molded with the carrier. Alternatively, the handle may be attached and be formed of alternate materials. When the handle is separately attached, it preferably includes a padded portion corresponding to where a user's fingers would be placed. In addition, a separately attached handle could include a hinge, allowing the handle to be shifted to facilitate stacking. While a flexible portion could be molded into an integral handle, this could compromise strength.

Each carrier is preferably provided with means for linking each container to stacked containers both upwardly and downwardly located. Therefore, the shapes of the upper and lower portions of the carrier with containers should correspond to the lower portion. Likewise, a latching mechanism is preferably provided for linking to upper and/or lower carriers which corresponds to a linking mechanism of a stacked container.

The linking mechanism is preferably a latch with a strong plastic or metal engagement. The latch is preferably releasable, allowing reuse of the carrier. A latch is preferably provided at each side of the carrier. Thus, each side of the carrier should preferably include a "male" and "female" latch component, for engagement with an upper (superior) and/or lower (inferior) stacked carrier. The preferred latching system is a so-called "PLANO-type" lock, with the extending portion mounted on the upper aspect of each side of the carrier and the extension-retaining portion mounted on the lower aspect of each side of the carrier.

In a preferred embodiment, the lower portion of the carrier includes an opening or recess which is slightly larger than the handle, to allow clearance for stacking. In an alternative embodiment, the handle portion and lower recess form a part of the interconnection system between adjacent stacked carriers, thus reducing the need for side mounted latches.

When a plurality of carriers according to the present invention are interlocked, they may be transported together as a single unit using the handle of the uppermost carrier. For example, with a carrier design having a two-by-three array, a stack of three carriers will provide a total of eighteen containers, allowing a high degree of organization of the items in the containers as well as a large capacity for storage.

A base unit is optionally provided with wheels. The base may engage the lowest carrier using the provided intracarrier connection mechanism, or a different linking system may be used. In addition, the base need not be linked to the carriers, and may rest through gravitational forces. Further, the base may have a mechanism for attachment to an entire stack of carriers, such as a woven belt.

The preferred base comprises a flat-bottom section with four snapped-in roller wheels, a handle-size section arising from the flat bottom and two PLANO-type lock buckles.

By use of a wheeled base, a stack of carriers may be transported, even though the weight may be great. For example, a stack of five carriers, each with six containers with steel parts would likely be too heavy to lift by the handle of the top carrier. However, the base allows free movement without need for lifting the entirely.

As an alternate embodiment, the roller wheels may be removed and the base may be permanently affixed to the floor of a van or the bed of a truck using predrilled holes. The carriers, stacked on the fixed base, will be immobilized and will not move or flip when the vehicle is in motion.

BRIEF DESCRIPTION OF THE DRAWINGS

The preferred embodiment invention will be described by way of example in the drawings, in which.

DETAILED DESCRIPTION OF THE PREFERRED EMBODIMENT

Figure 1:
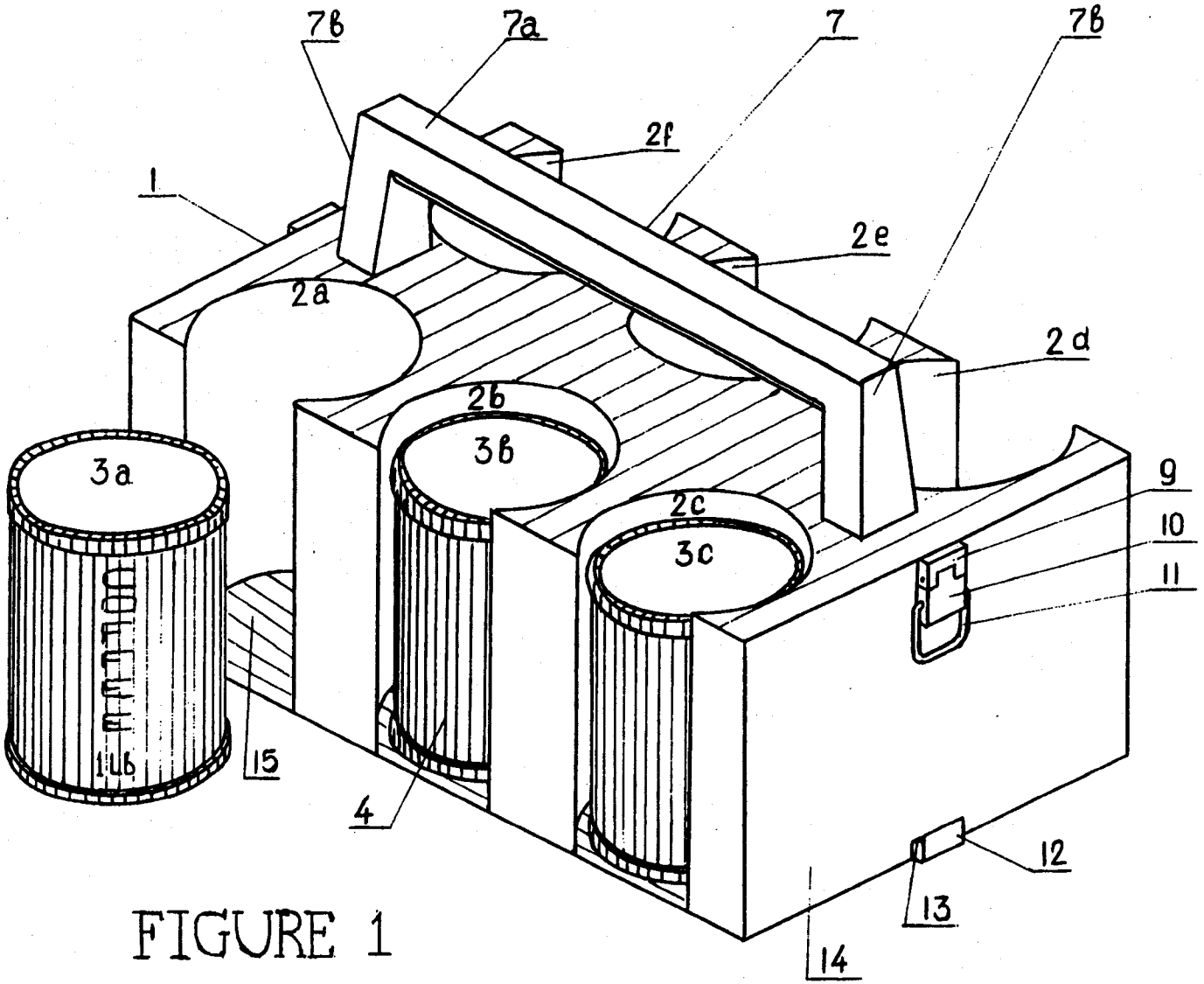
FIG. 1 is an isometric view of a carrier with containers in accordance with the present invention.

FIG. 1 shows an isometric view of a carrier according to the present invention. A carrier 1 includes six defined spaces *2a, 2b, 2c, 2d, 2e, 2f* for containers *3a, 3b, 3c*. The defined spaces confine the containers *3a–c* in the two horizontal axes x, y, while allowing movement along the vertical axis z. The carrier 1 need not fully surround the containers *3a–c*, and in fact if a portion of the container 4 is visible from the side, it is easier to determine the contents of a carrier 1, especially if stacked. The containers *3a–c* shown may be standard 1 lb. coffee cans, which are approximately 5½" high by 4½" diameter. Other size and shape containers may also be accommodated.

A lower surface 15 is provided to support the containers *3a–c* when the carrier is lifted.

The preferred embodiment consists of a two-by-three array of spaces *2a–f* for contains. The column of three containers are separated by a small space, including enough material 5 of the carrier 1, to ensure mechanical strength. The two columns of containers are separated by a larger spacing 6. Coincident with the larger space 6 is the handle 7, which includes an elongated member *7a* suitable to be held and carried by a human hand, and struts *7b* which space the elongated member *7a* from the upper surface 8 of the carrier, allowing clearance for use of the handle 7. The handle 7 is formed so that it does not interfere with the insertion and removal along the vertical axis z of containers *3a–c* in the spaces *2a–f*. Thus, the spacing of material 5 between the columns of three containers is greater than the spacing 6 within the columns between the containers *3a, 3b, 3c*.

Figure 5:
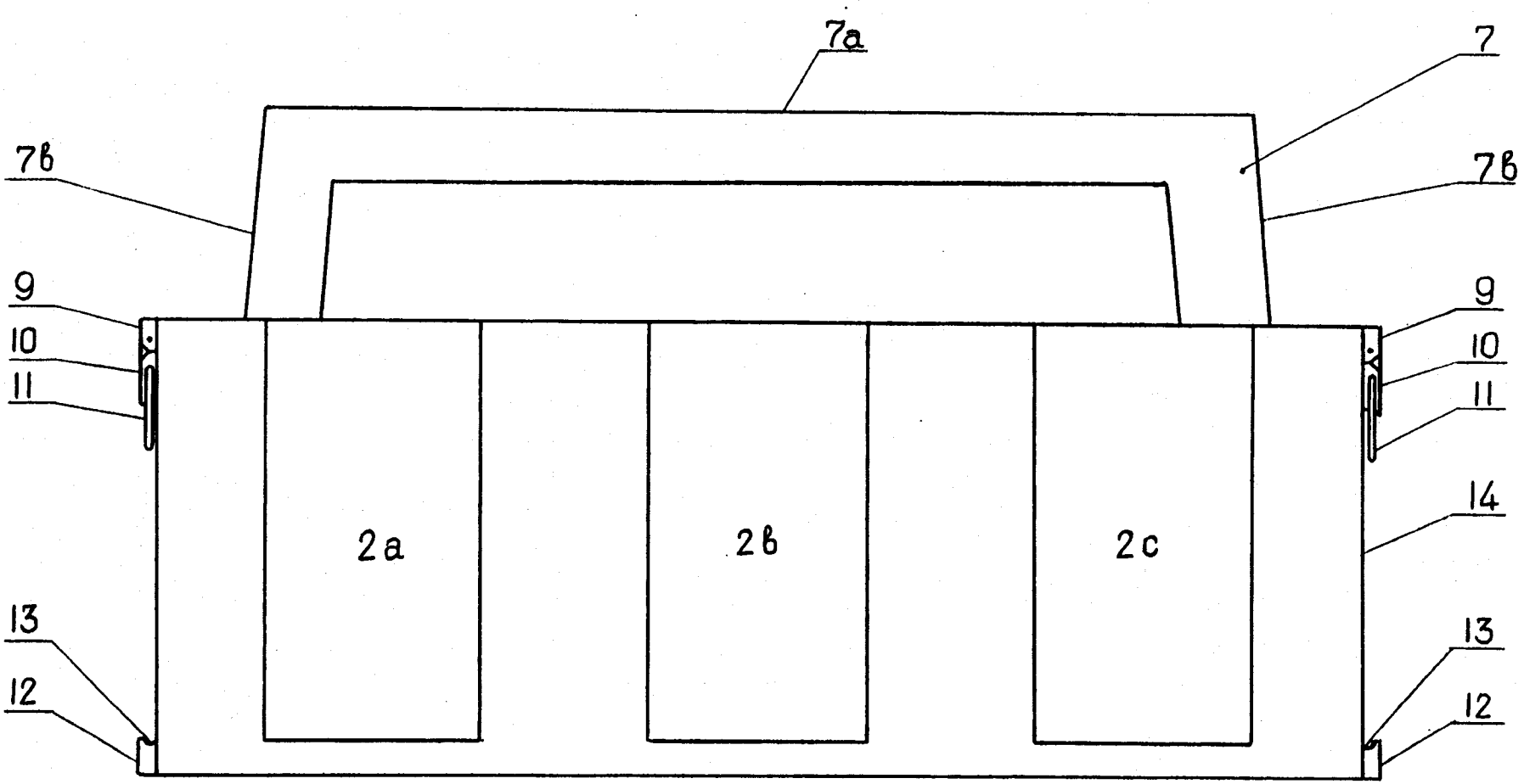
FIG. 5 shows a side view of a carrier according to the present invention.
Figure 6:
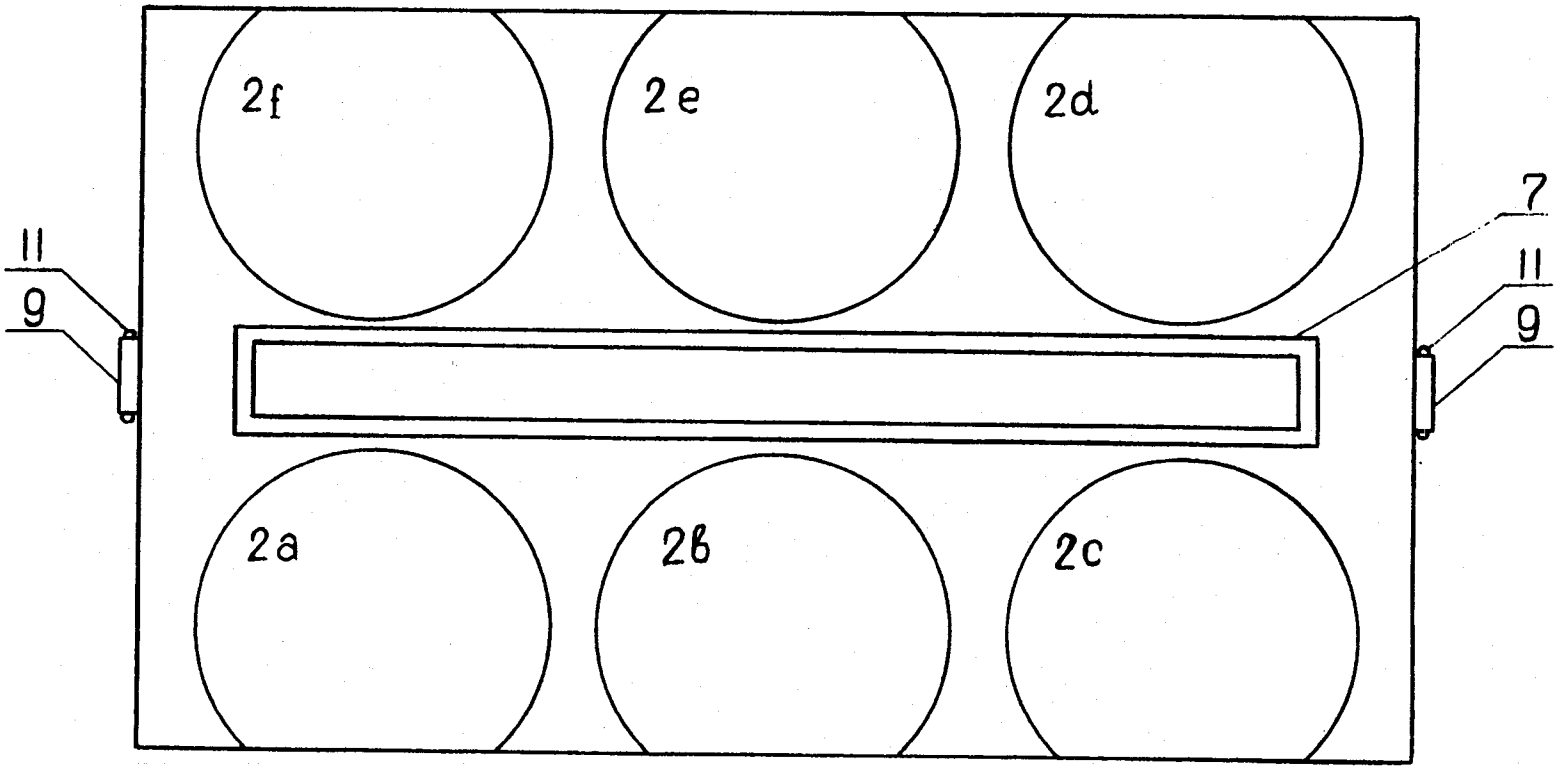
FIG. 6 shows a top view of a carrier according to the present invention.

FIGS. 5 and 6 show a side and top view of the carrier 1, numbered corresponding to FIG. 1. In the preferred embodiment, each space *2a–f* is a 4½" diameter aperture, with the outer approximately ½" open to show a portion of a container 4. In this embodiment, each space *2a–2b, b–2c, 2d–2e* and *2e–2f* is separated by approximately ½", thus there is approximately ½" material 5 between the containers. The entire carrier 1 is approximately 16½" wide by 10" long. The larger spacing 6 between columns *2a, 2b, 2c* and *2d, 2e, 2f* is approximately 2". The handle 7 is approximately 13½" long, 1" wide, and extends approximately 3" above the top surface 8 of the carrier 1. The struts *7b* are angled inwardly. The lower surface of the carrier 1 is approximately ½" thick. The latch mechanism 9, 10, 11, 12, 13 extends approximately 6" outward from the side 14 of the carrier. The carrier 1, exclusive of the handle 7, is approximately 6½" in height.

FIG. 1 also shows the latch mechanism, which includes an attachment 9, a tensioner 10 and a band 11 as one part, and a retainer 12 with surface 13 as another part. The band 11 and tensioner 10 each have rotational freedom along one axis. When another carrier with a retainer corresponding to retainer 12 is placed above the carrier 1, the handle 7 fits into a recess formed in the lower portion of the carrier. The portions of the latch mechanisms of each carrier align. The band 11 may be rotated to swing upwardly, with the tensioner 10 providing a lateral and upward displacement of the band 11 from the side 14 of the carrier 1. The band 11 then may be made to engage the corresponding surface 13 of corresponding retainer 12 of the upper carrier. The tensioner 10 may then be rotated downward, bringing the band 11 nearly flush with the side 14 of the carrier 1, tensioning the band 11 against the corresponding surface 13 of the upper carrier and locking the two carriers together. Latching mechanisms are provided on both sides of the carrier 1, along a central axis, aligned with the handle 7. Other types of latches may be used, as known by those skilled in the art.

Figure 3A:
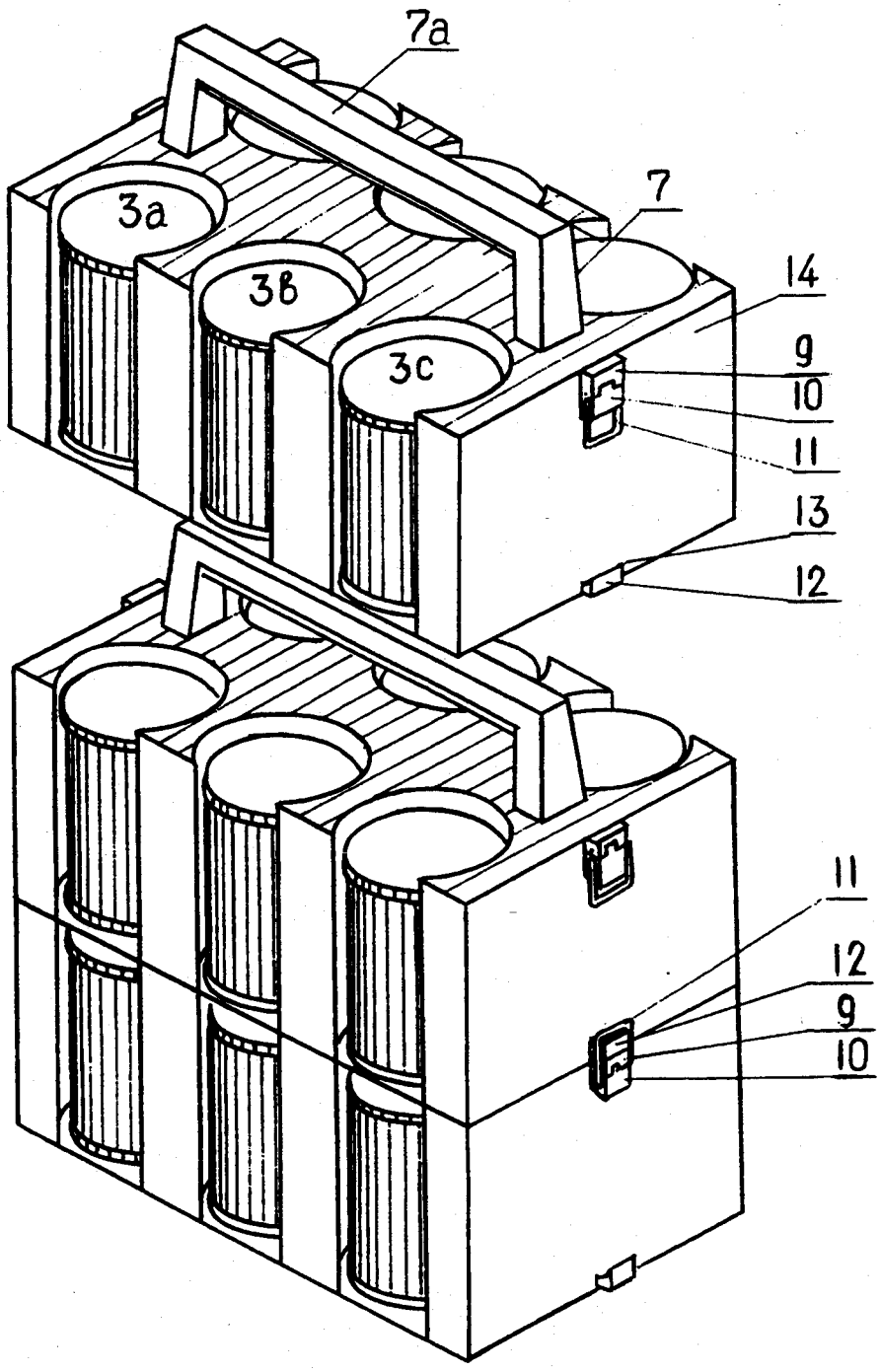
FIG. 3A is an isometric exploded view of three stackable carriers with containers according to the present invention.
Figure 3B:
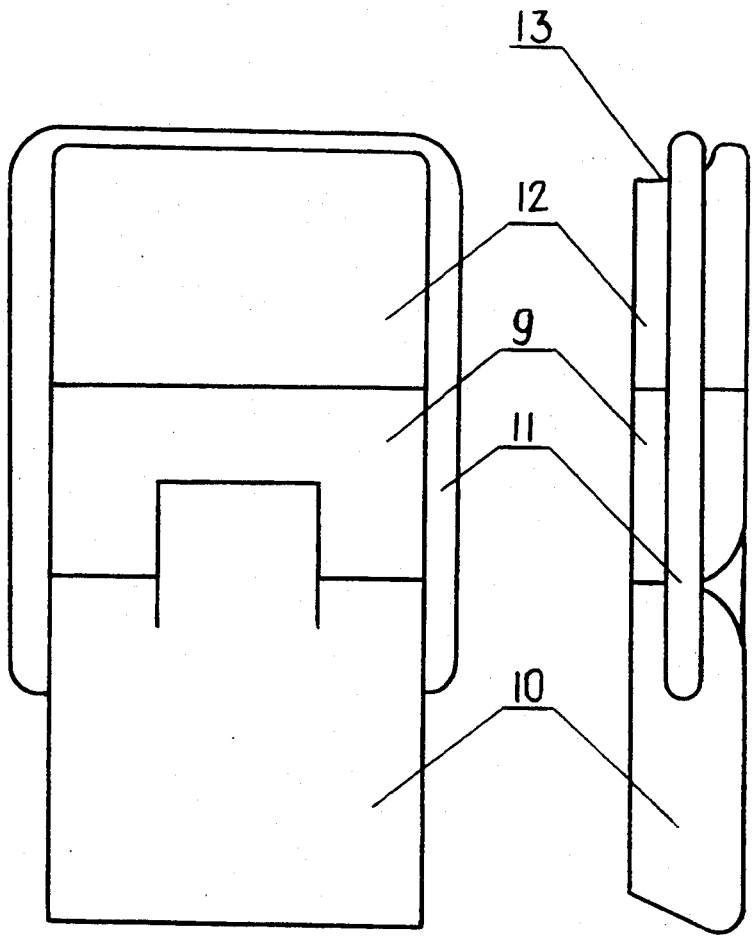
FIGS. 3B and 3C show a front view and side view, respectively, of a Plano-type latch in both latched and unlatched positions used to link stacked carriers according to the present invention.
Figure 3C:
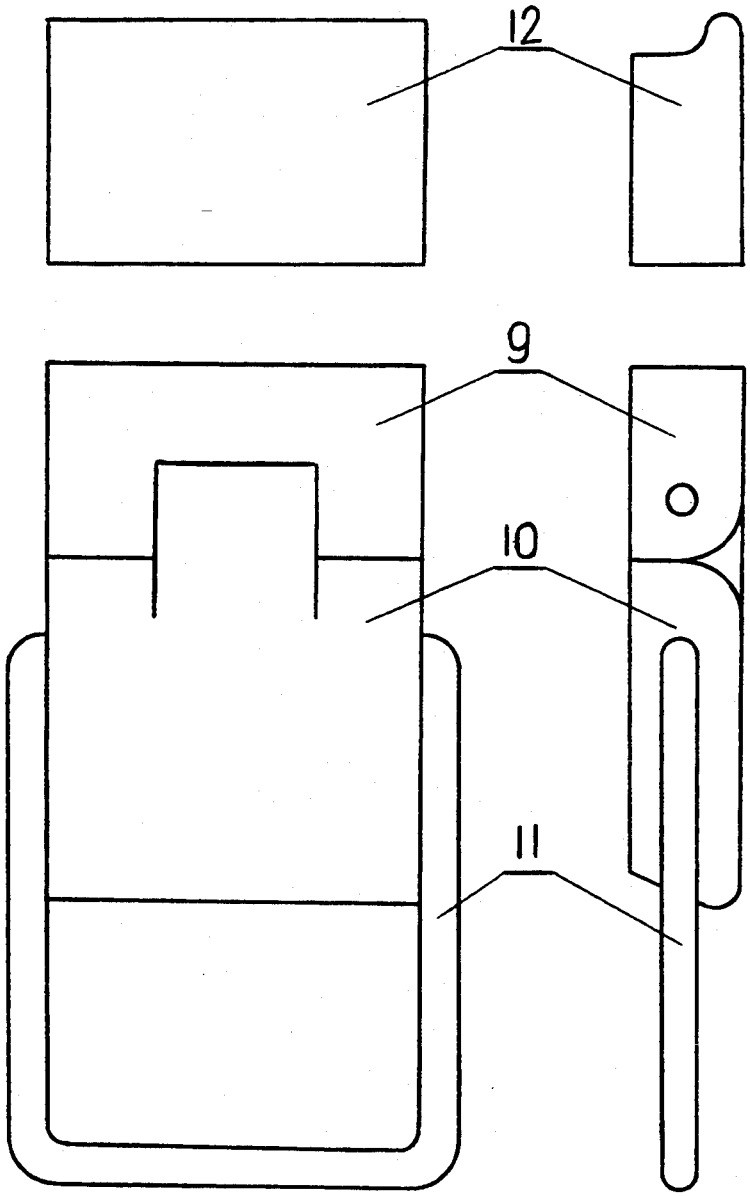

FIGS. 3B and 3C detail a front and side view of this patch in the latched and unlatched positions, with corresponding numbering to the latch shown in FIG. 1.

Figure 2A:
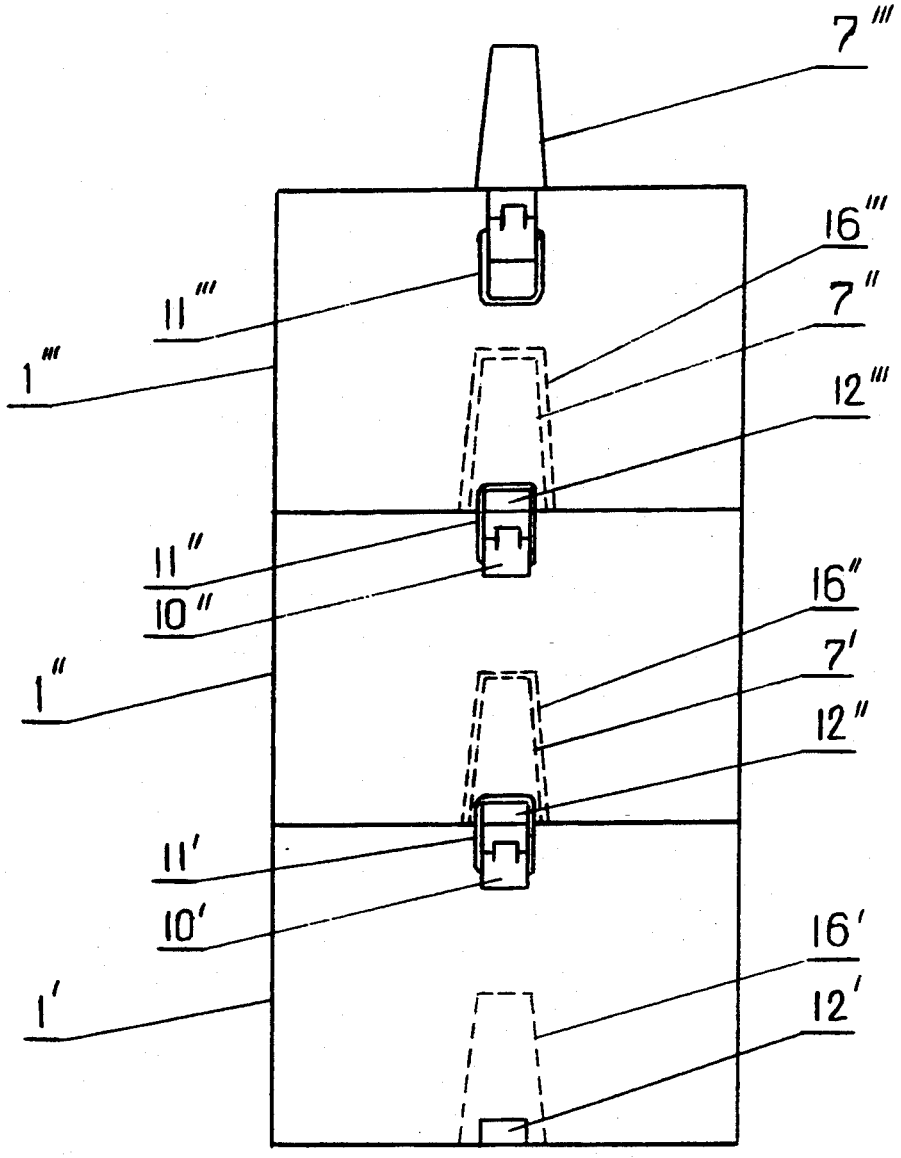
FIG. 2A is a side view of three stacked carriers according to the present invention showing latches.
Figure 2B:
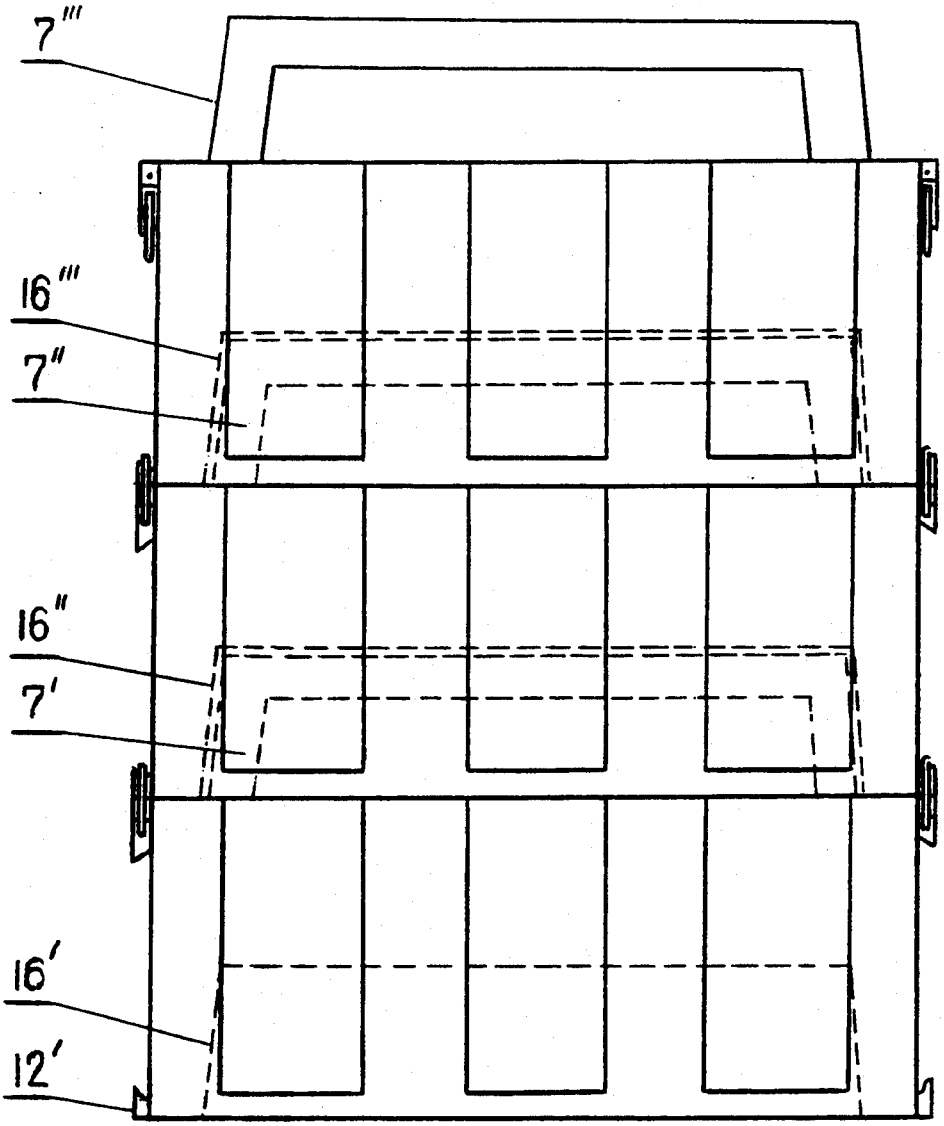
FIG. 2B is a front view of three stacked carriers according to the present invention.

FIGS. 2A and 2B show a side and front view respectively of three stacked carriers. bands 11', 11" bind retainers 12", 12"' respectively. FIGS. 2A and 2B clearly show the clearance space 16', 16", 16"' provided in the bottom central portion of the carrier for an upwardly extending handle 7', 7", 7"' from a carrier 1', 1", 1"' placed below.

FIG. 3A shows an exploded view of a stack of three carriers, each with a two-by-three array of containers. Reference numerals are placed corresponding to FIGS. 2A and 2B.

Figure 4A:
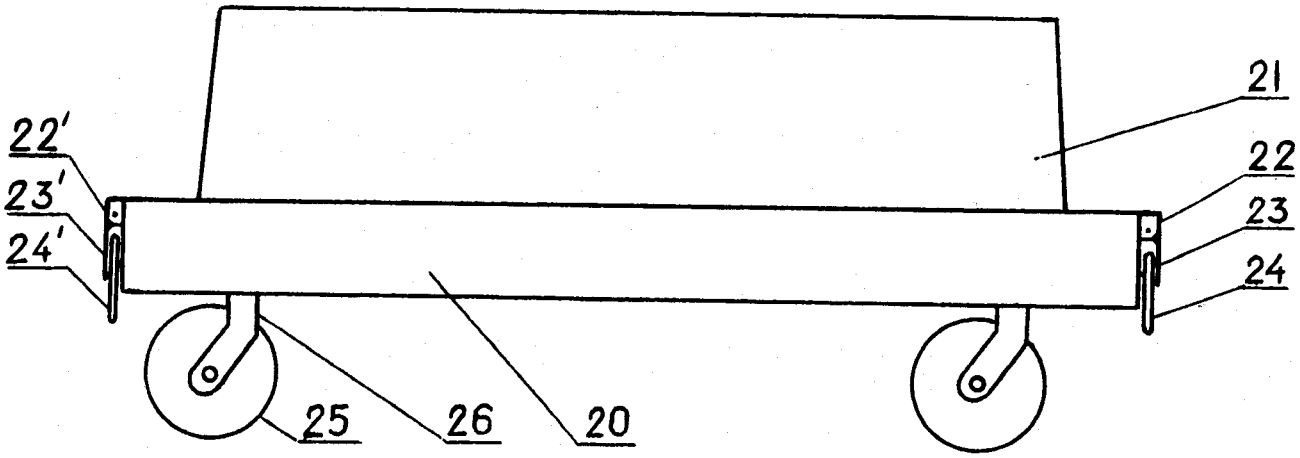
FIGS. 4A and 4B show a top view and a side view of a base with wheels according to the present invention.
Figure 4B:
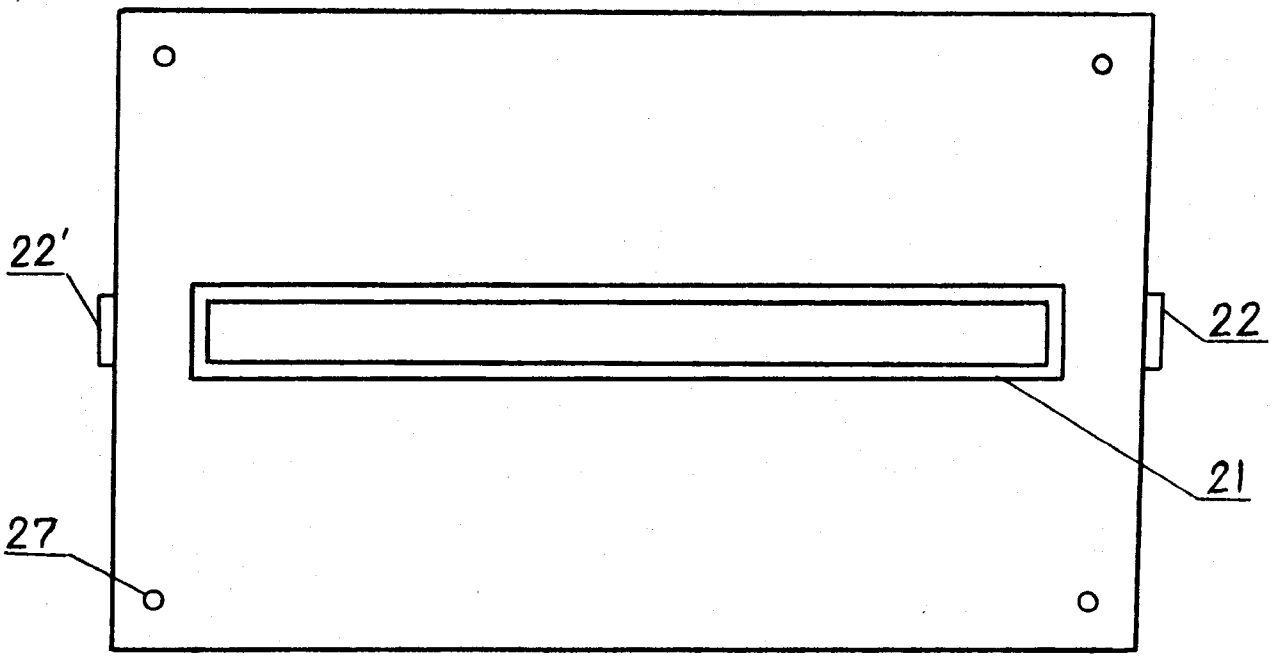

FIG. 4A and 4B show a top and side view of a base 20. The base 20 has an upper central protruding portion 21, which corresponds in shape to the handle 7 of a carrier, and may be guided into the recess 16 in the bottom of a carrier 1. The base also includes the attachment 22, 22', tensioner 23, 23' and band 24, 24' corresponding to the latch parts 9, 10, 11 of a carrier, so that a carrier may be latched by its retailer 12 to the base 20. The base may have wheels 25, as shown, or may be firmly attached to an object, such as a truck. The points of attachment 27 may be used for either the swivel 26 for the wheels 25 as shown, or for bolting to a truck bed or the like.

EQUIVALENTS

The above description, figure and preferred embodiments are provided not to limit the invention but to assist one skilled in the art in better understanding the invention contained herein. The inventor is not thereby limited to the preferred embodiments, but is only limited by the scope of the claims below. One of reasonable skill in the art can also practice the invention through other and equivalent methods, compositions and techniques which are, as well, included within the scope of the invention, to the extent set forth in the appended claims.

What is claimed is:

1. A generally rectangular stackable carrier having a closed bottom portion, a top portion and first and second opposing sides, the carrier for carrying a plurality of reusable, cylindrical containers, comprising:

(a) a plurality of concave cylindrical apertures extending from the bottom portion of the carrier to openings in the top portion of the carrier and arranged along each of said first opposing sides of said carrier, said apertures each also having openings at said first opposing carrier sides coextensive with said openings in the carrier top portion, such that each aperture is capable of only partially encircling a cylindrical container therein, each aperture defined by walls that radiate upwardly from the bottom portion of the carrier towards the top portion;

(b) a handle conformed on the top portion of the carrier and extending upwardly therefrom;

(c) a recessed area on the bottom portion of the carrier having a conformation complementary to said handle; and (d) a latching mechanism for securing the carrier with a second carrier.

2. A stackable carrier according to claim 1, wherein said latching mechanism has a male part and a female counterpart each of which is disposed on said second opposing sides of the carrier.

3. A stackable carrier according to claim 1, further comprising a base with wheels wherein the carrier is removably mounted to said base with said latching mechanism.

4. A carrier handling system, comprising:

(a) a plurality of generally rectangular stackable carriers, each having a closed bottom portion, a top portion and first and second opposing sides, each carrier for carrying a plurality of reusable, cylindrical containers, comprising:

(1) a plurality of concave cylindrical apertures extending from the bottom portion of the carrier to openings in the top portion of the carrier and arranged along each of said first opposing sides of said carrier, said apertures each also having openings at said first opposing carrier sides coextensive with said openings in the carrier top portion, such that each aperture is capable of only partially encircling a cylindrical container therein, each aperture defined by walls that radiate upwardly from the bottom portion of the carrier towards the top portion;

(2) a handle conformed on the top portion of each carrier and extending upwardly therefrom;

(3) a recessed area on the bottom portion of each carrier having a conformation complementary to said handle; and (4) a latching mechanism for securing each carrier with another carrier.

* * * * *